United States Patent [19]

Park

[11] 3,930,758

[45] Jan. 6, 1976

[54] MEANS FOR LUBRICATING SWASH PLATE AIR CONDITIONING COMPRESSOR

[75] Inventor: Kwang H. Park, Dearborn Heights, Mich.

[73] Assignee: General Motors Corporation, Detroit, Mich.

[22] Filed: Mar. 22, 1974

[21] Appl. No.: 453,570

[52] U.S. Cl. ..... 417/269; 184/6.16

[51] Int. Cl.[2] ..... F04B 1/12; F01M 1/00

[58] Field of Search ..... 417/269, 312; 91/502; 184/6.16, 6.18

[56] References Cited

UNITED STATES PATENTS

| | | | |
|---|---|---|---|
| 3,057,545 | 10/1962 | Ransom et al. | 417/269 |
| 3,215,341 | 11/1965 | Francis | 417/269 |
| 3,380,651 | 4/1968 | Niki et al. | 417/269 |
| 3,577,891 | 5/1971 | Nemoto | 417/312 |
| 3,750,848 | 8/1973 | Nakayama | 184/6.16 |
| 3,801,227 | 4/1974 | Nakayama | 417/269 |
| 3,838,942 | 10/1974 | Pokorny | 417/269 |

*Primary Examiner*—William L. Freeh
*Assistant Examiner*—G. P. LaPointe
*Attorney, Agent, or Firm*—Edward P. Barthel

[57] ABSTRACT

A six-cylinder swash plate air conditioning compressor having reciprocal double-acting pistons within a swash plate chamber positioned centrally between axially spaced front and rear cylinder blocks having intermediate suction and discharge gas crossover passageways in the cylinder blocks. The swash plate chamber provides a crankcase for receiving lubricant returned from the front head suction chamber by means of piston blow-by during the compression stroke of the pistons. The suction pressure in the crankcase is at a higher level than the pressue in the suction gas crossover passageway while being at a lower level than the pressure in the cylinder head gas discharge chamber creating the necessary positive pressure gradient to circulate the lubricant internally within the compressor. Radial slots are formed in the cylinder block outer faces to provide first and second internal lubricant differential pressure flow passages between the shaft thrust and journal bearings and the cylinder block suction cavities communicating via the suction crossover passageway to the front head suction chamber.

3 Claims, 5 Drawing Figures

MEANS FOR LUBRICATING SWASH PLATE AIR CONDITIONING COMPRESSOR

This invention relates to a swash plate air conditioning compressor having double-acting pistons therein driven by the swash plate, and more particularly to an improved lubricating system for such compressors.

Present swash plate automotive air conditioning compressors as exemplified in U.S. Pat. No. 3,057,545, issued to Ransom et al. and assigned to the same assignee as the instant invention have proved highly successful. As shown in the Ransom et al. patent there is provided a rotor gear oil pump on the extension of the drive shaft which serves to withdraw oil from a distended sump formed in the compressor outer casing through an oil pickup tube which communicates with aligned passages in the compressor components to convey the oil throughout the compressor for return to the sump. In order for the sump to be positioned at the lowermost portion of the cylinder it has necessitated that the cylinders, which are arranged on the corners of a regular triangle, be oriented with a single piston on top and two pistons down to allow the oil pickup tube to be located between the two lower pistons for communication with the oil sump. Consequently the prior art swash plate compressor lubricating system not only requires additional parts and increased manufacturing costs but limits the axial positioning of the compressor to a single orientation.

Accordingly, it is an object of the present invention to provide a swash plate air compressor with an improved lubricating system which is more reliable in operation while eliminating a lubrication pump and bulged casing pump of prior art swash plate compressors to reduce manufacturing operations and material costs.

It is another object of the present invention to provide an improved swash plate six-cylinder axial drive compressor incorporating three double-acting pistons arranged on the corners of a regular triangle which provides a differential pressure lubrication system between the swash plate crankcase oil chamber and the drive shaft thrust and journal bearings of the compressor whose inlet and outlet lines communicate with only one of the cylinder heads disposed within opposite ends of the compressor cylindrical casing such that the compressor can be axially oriented over a range of positions.

These and other objects and advantages of the present invention will be apparent from the following description, reference being had to the accompanying drawings wherein a preferred embodiment of the present invention is clearly shown.

IN THE DRAWINGS

Figure 1:
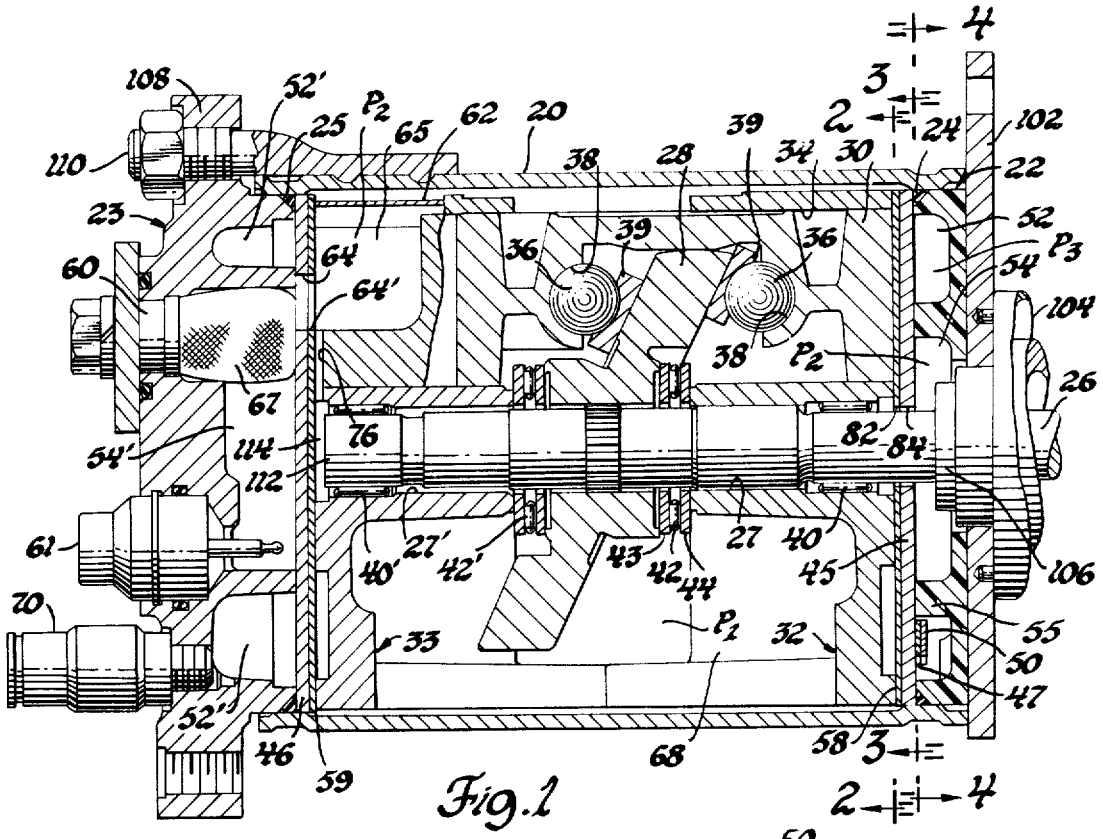
FIG. 1 is a vertical sectional view of the swash plate compressor with portions rotated into the vertical plane for clarity.

Referring now to the drawings wherein a preferred embodiment of the invention has been shown, reference numeral 20 designates an outer case or housing element, preferably fabricated from aluminum, which is cylindrical in shape and serves to support a pair of front and rear cylinder heads 22 and 23, respectively, which close the front and rear opposite ends of the housing 20 in a sealed manner by suitable means, such as by O-rings 24 and 25. Reference numeral 26 designates the compressor axial drive shaft, located in front and rear axial bores 27 and 27 and 27', respectively, which has keyed to it a swash plate 28. The swash plate 28 serves to actuate three double-acting die cast pistons 30 which are arranged 120° apart on the corners of a regular triangle to reciprocate in a direction parallel to the axis of the shaft 26.

A pair of front and rear cylinder halves or blocks 32 and 33 are provided, as shown, and these cylinder blocks are supported within the outer casing 20 and are each provided with three cylindrical bores 34 in which their associated double-acting pistons 30 reciprocate in response to rotation of the shaft 26. Each of the pistons 30 has a central part on its one side cut away as shown so as to straddle the outer edge of the swash plate 28. Rotation of the swash plate 28 causes reciprocation of the pistons 30. In order to minimize the fricton between the swash plate and the pistons, there is provided a series of ball bearings 36 which are disposed between ball sockets 38 formed in the piston elements 30 and thrust bearing shoes 39 which are arranged to slide on the swash plate 28 as shown in FIG. 1. For details of the construction of a swash plate compressor reference should be had to U.S. Pat. No. 3,057,545, issued Oct. 9, 1962, to G. P. Ransom et al., assigned to the assignee of the instant invention, the disclosure of which is incorporated by reference herein.

By virtue of the bearing construction shown herein, the piston pumping loads are taken both by front and rear radial or journal needle bearings 40 and 40' and front and rear needle thrust bearings 42 and 42', respectively. Inner and outer thrust washers 43 and 44 are positioned on either side of the front and thrust bearings 42, 42' and shaft end play is adjusted by means of selecting outer thrust washers 44 of the proper thickness.

Figure 3:
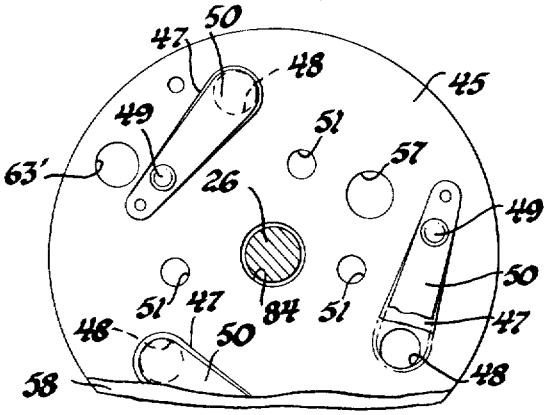
FIG. 3 is a view taken on line 3—3 of FIG. 1, showing a portion of the outer face of the front outlet valve plate.
Figure 4:
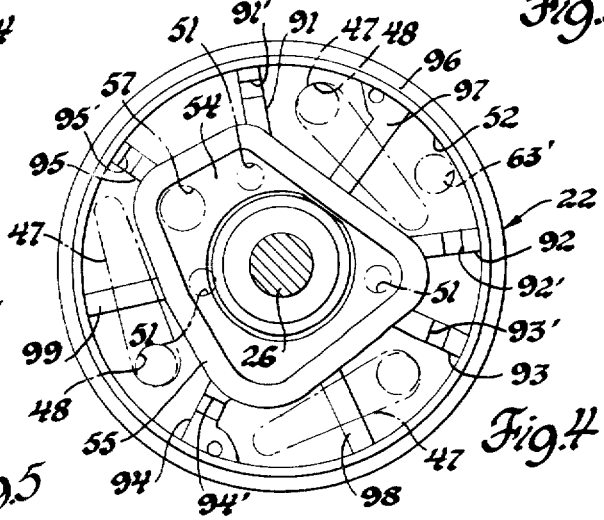
FIG. 4 is a view taken on line 4—4 of FIG. 1, showing the inner face of the front cylinder head.

Separate front and rear outlet or refrigerant gas discharge valve plates 45 and 46 having reed valves, such as the reed valves 47, shown in FIG. 3 for front valve plate 45, are provided adjacent each end of the cylinder blocks 32 and 33 for covering three outlet ports 48. The reed valves 47 are held against the valve plate 45 by rivet fasteners 49 and backup strips 50. Each valve plate is also provided with suction inlet ports 51 registering with the suction reed valve plate openings (not shown) while the valve plate outlet ports 48 provide communication between the pumping cylinder bores 34 and front and rear head discharge gas chambers 52 and 52', respectively. As seen in FIG. 4 the front cylinder head 22 has an intermediate generally quadrilateral closed loop island 55 defining the front head low pressure or suction chamber 54 which communicates with all three suction gas inlet ports 51 while the outlet valve plate opening 57 and suction reed valve plate opening 56 provide communication with a suction gas crossover passageway 53 to be described. Conventional front and rear intake or suction reed valves 58 and 59 respectively, are provided adjacent each end face of the cylinder blocks for control of the inlet ports 51. The details of a typical intake reed valve plate are shown in the Ransom et al patent and reference should be had thereto.

Figure 5:
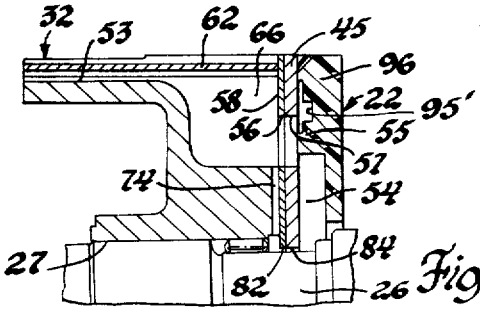
FIG. 5 is an enlarged fragmentary sectional view taken substantially on the line 5—5 of FIG. 2.

As seen in FIG. 1, the gas to be compressed is admitted to the rear suction chamber 54' through suction inlet line 60 and inlet cup-shaped filter screen 67. The rear head 23, shown formed of steel material, has a suction relief valve 61. The rear head suction chamber 54' communicates with rear cylinder block 33 cutaway suction cavity, shown at 65 in FIG. 1 in an axially revolved position relative to front cylinder bore 34, via rear valve plate opening 64 and rear reed valve opening 64'. A longitudinally extending cutaway suction gas passage 53 in block 32, shown in FIGS. 2 and 5, and its counterpart passage in block 33 (not shown) mate and when enclosed by a cover member 62 communicates at each end with the front and rear suction cavities so as to convey a portion of the suction gas from the rear suction chamber 54' in the rear cylinder head 23 to the corresponding front suction chamber 54 in the front cylinder head 22.

Figure 2:
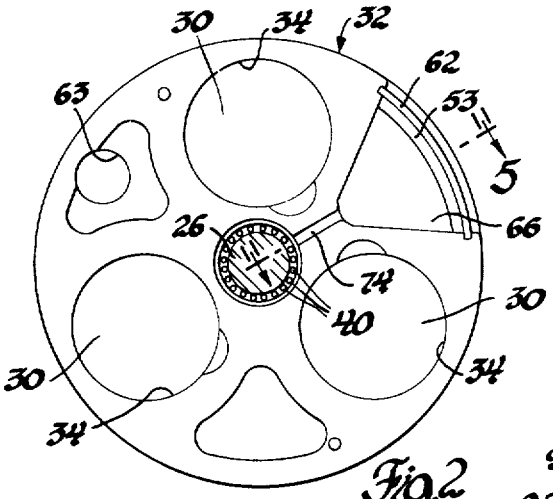
FIG. 2 is a view taken on the line 2—2 of FIG. 1, showing the outer end of the front cylinder block.

Compressed gas is discharged into both the front and rear cylinder head discharge chambers 52 and 52' and, therefore, it is essential to provide means for connecting the discharge chambers by means of a discharge gas crossover tube, the front block opening for which is shown in FIG. 2 at 63 and whose front end communicates with opening 63' in front valve plate 45. The details of one such tube are shown in the above-mentioned Ransom et al. patent. The compressed refrigerant gas leaves the compressor discharge chambers through outlet valve 70.

The swash plate chamber or crankcase 68 positioned centrally between the axially spaced front and rear cylinder blocks provides an oil sump region having a liquid level sufficient to immerse the outer edge portion of the swash plate 28. The use of the crankcase 68 as the oil sump which is within the confines of cylindrical casing 20 is to be contrasted with the prior art lubricating systems as shown by the Ransom et al. U.S. Pat. No. 3,057,545, which provides a bulge portion in the lowermost position of the casing to form the oil sump. The prior art oil sump is located remotely from the lower edge of the swash plate 28 and thereby requires a pumping means such as a gear type oil pump shown in the Ransom et al. patent rotatably driven by being affixed on a rearward extension of the shaft 26. The Ransom pump is required to withdraw oil from the sump through an oil pickup tube, located between the pair of lower positioned cylinders, to convey oil to the inlet side of such gear type oil pump.

In the present invention the lubricant returned from the air conditioning system to the compressor is received into the swash plate chamber or lubricant crankcase 68 by means of piston blow-by during the compression stroke of the pistons 30. At the same time, the pressure $P_1$ in the crankcase chamber 68 is increased beyond the suction pressure $P_2$ in the suction gas rear cavity 65, front cavity 66 and connecting crossover passageway 53 formed on each of the cylinder blocks and enclosed by a sheet metal cover plate 62 the edges of which are shown flexibly received in longitudinal slots. This condition exists because the only communication between the swash plate chamber 68 is via lubricant passage means provided therebetween which will be described. This structure is to be contrasted with the Ransom et al patented compressor which provides pressure equilization passage means between the suction cavities 65, 66 and the swash plate chamber 68.

Thus, when pressure $P_3$ is created at the top of the compression stroke of the pistons 30 in the piston cylinders and in the discharge chamber 52, which $P_3$ pressure is greater than crankcase pressure $P_1$ whereby the necessary internal pressure differential gradient lubricant driving means required to circulate the lubricant from one component of the compressor pump to another is established. The high pressure buildup $P_1$ in the crankcase chamber 68 is relieved through the lubricant passage means or route provided which include the front and rear thrust bearings 42 and 42'; and the front and rear shaft journal bearings 40, 40' and front and rear radial slot means formed on both outer end surfaces of the front and rear cylinder blocks 32 and 33. Front radial slot 74 in front block 32, shown in FIGS. 2 and 5, serves to connect the shaft bore 27 to the front head suction cavity 54 by means of passage 56 in the suction reed valve plate 58 aligned with passage 57 in the front outlet valve plate 45.

A first internal flow path for the pump lubrication system is established by oil being drawn by differential pressure from the crankcase chamber 68 past rear thrust bearings 42' through rear shaft bore 27', rear journal bearings 40' and upwardly via differential pressure through rear radial slot 76 for differential pressure flow into the rear suction cavity 65 for mixture with the suction refrigerant gas flow through crossover passageway 53, front suction cavity 66 and into front head suction chamber 54 for return differential pressure flow back to the compressor crankcase chamber 68 by means of piston blow-by during the outward compressor stroke of piston 30 toward front head 22 independent of the external oil gas flow through the air conditioning system.

A second internal flow path for the pump lubrication system is established by oil being drawn by the differential pressure gradient from the crankcase chamber 68 past forward thrust bearings 42 through forward shaft base 27, front journal bearings 40 and upwardly via differential pressure through front radial slot 74 into front suction cavity 66 for mixture with the refrigerant suction gas so as to flow via suction reed valve plate passage 56 and discharge valve plate opening 57 into the front head suction chamber 54 for return differential pressure flow back to the crankcase 68 by means of piston blow-by. It will also be noted that the oil may be drawn by differential pressure through the shaft opening 82 in the suction reed valve plate and the shaft opening 84 in the discharge valve plate into the front head suction chamber 54.

Thus, it will be appreciated that by placing the shaft 26 forward end in communication with the front head suction chamber 54 so as to place the bore 27 at suction pressure $P_2$ rather than at crankcase pressure $P_1$, as shown by the Ransom et al patent, applicant provides a second differential pressure flow path from bore 27 into chamber 54 via shaft openings 82 and 84. This insures sufficient oil flow into chamber 54 for mixture with the refrigerant suction gas for external circulation throughout the refrigeration system via the outlet crossover tube into discharge chamber 52' and outlet valve 70 for external circulation throughout the refrigeration system and eventual return via suction inlet line 60 and screen filter 67 into rear head suction chamber 54' which is in communication with the rear cylinder block suction cavity 65 via openings in the rear valve plate 46 and rear suction reed valve plate 59 similar to the openings shown for the front cavity 66 and chamber 54. In other words, there are two loops of oil circulation system, i.e. one internal differential pressure system not leaving the compressor pump and the external system through the air conditioning system. It has been verified in tests conducted with the disclosed compressor that the pressure gradient between the crankcase chamber 68 pressure $P_1$ and the suction pressure $P_2$ in cavities 65, 66 that there is always a positive suction pressure gradient at all operating conditions resulting in a system where the lubricant is constantly being internally circulated through the compressor journal and thrust bearings.

It will be appreciated that by elimination of the gravity feed oil sump bulge and pickup tube of the Ransom patent it is not necessary that the compressor be orientated with the one piston bore at top center and two bores below as shown in FIG. 2. This arrangement is necessary with the Ransom patent to allow for the gravity return to the sump through a vertical passage and also because the Ransom oil pickup tube must be located between a pair of the cylinder piston bores.

With reference to FIG. 4 the inner face of the front head 22 is molded to provide five radial ribs 91 through 95 defining three discharge pockets, namely cavities between ribs 91 and 92, 93 and 94, and 94 and 95. These discharge pockets will provide a muffler effect on the discharge gas while also serving to reinforce the intermediate closed loop island by connection with outer peripheral rim 96. It will be noted that intermediate low radial reinforcement ribs 97, 98 and 99 are provided, having about one-half thickness relative to ribs 91–95, maintaining a clearance space with the backup strips 50 of the discharge reed valves 47. Also, the high ribs 91–95, defining three head discharge pockets therebetween, function to enclose each of the discharge reed valves 47 and prevent any broken reeds 47 or strips 50 from "floating" around the otherwise annular discharge chamber 54. Grooves 91'–95' are formed in the high ribs 91–95 to allow the passage of discharge gas between the three discharge pockets. It is within the contemplation of the invention that the rear head 23 may also be molded of plastic material and have similar discharge gas pockets for muffling sound energy in gases flowing therethrough.

It will be noted in FIG. 1 that a mounting plate 102, suitably secured as by welding to the outer casing 20, is provided to mount in axial fashion a clutch assembly (not shown) by means of bracket 104. The clutch, for example, may be of the type disclosed in U.S. Pat. No. 3,759,058 and assigned to the same assignee as the subject application. A suitable shaft seal 106 is shown positioned in the mounting plate 102. While the rear head 23 is shown formed of metal and secured by radial flange ears 108 to threaded lugs 110 it will be appreciated that the rear head 23 could be molded of plastic material in the manner of front head 22. It will also be noted that the end 112 of shaft 26 is spaced a defined axial distance from reed valve plate 59 to provide a clearance or closed end space 114 from which the lubrication oil is drawn upwardly into rear radial slot 76 from the rear journal bearings 40'.

While the embodiment of the present invention as herein disclosed constitutes a preferred form, it is to be understood that other forms might be adopted.

I claim:

1. In a compressor, a cylindrical casing element, a pair of cylinder blocks disposed intermediate the ends of said cylindrical casing element defining a crankcase therebetween, front and rear cylinder heads disposed within opposite ends of said cylindrical casing element, said rear cylinder head having an inlet suction line and an outlet discharge line, valve plate means interposed between said cylinder heads and said cylinder blocks and having inlet and outlet ports therein, said cylinder heads each having a circular peripheral rib and an intermediate closed rib island defining an inner suction inlet chamber and an outer discharge outlet chamber adjacent said inlet and outlet ports respectively, the inlet and outlet chambers in said rear cylinder head being in communication with said inlet suction line and said outlet discharge line, respectively; a compressor drive shaft having its ends rotatably mounted in front and rear axially spaced bores of said cylinder blocks by means of front and rear needle journal bearings, said cylinder blocks having first passage means for conveying compressed gas between said head outlet chambers, each of said cylinder blocks each having a suction cavity in their outer end faces to provide front and rear suction cavities, said cylinder blocks having second suction crossover passage means therein for connecting said front and rear suction cavities, said cylinder blocks having three pairs of aligned pumping chambers spaced radially outward from the central axis of said shaft, three double ended pistons arranged to reciprocate within associated pairs of said pumping chambers, a swash plate disposed between said cylinder blocks and secured to said shaft so as to rotate therewith, means whereby rotation of said swash plate imparts reciprocation to said double ended pistons, front and rear drive shaft needle thrust bearing assemblies between said swash plate and the inner ends of said front and rear shaft bores so as to be in communication with the crankcase chamber, wherein the improvement comprising having the rear end surface of said shaft spaced a defined distance from the inner surface of said rear valve plate means, the front end of said shaft extending through aligned openings in said front valve plate means and through said front head suction chamber whereby said front shaft bore is in communication therewith, said aligned openings of a sufficient diameter to permit oil to flow from said front shaft bore into said front head suction chamber, said rear cylinder block having a radial slot formed in its outer transverse face providing communication between said rear suction cavity and the outer end of said rear shaft bore, whereby a differential suction pressure gradient is created therebetween which cooperates with the oilrefrigerant gas piston chamber blow-by during each compressive stroke of the pistons to provide a first flow of lubricating oil through the compressor rear needle thrust and journal bearings, said first oil flow being from said crankcase through said rear thrust bearings and rear journal bearings via said rear shaft bore for radially outward flow in said rear radial slot into said rear suction cavity, and thence via said suction crossover passage into said front suction cavity for differential pressure flow into said front head suction chamber and thence via piston blow-by into said front piston chambers for differential pressure return to said crankcase, and said second oil flow being from said crankcase through said front thrust and front journal bearings and thence via said front shaft bore through said aligned shaft openings into said front head suction chamber for return to said crankcase with said first oil flow.

2. In a compressor, a cylindrical casing element, a pair of cylinder blocks disposed intermediate the ends of said cylindrical casing element defining a crank case therebetween, front and rear cylinder heads disposed within opposite ends of said cylindrical casing element, said rear cylinder head having an inlet suction line and an outlet discharge line, front and rear valve plates interposed between said front and rear cylinder heads and said cylinder blocks respectively, and having inlet and outlet ports therein, said cylinder heads each having a circular peripheral rib and an intermediate closed rib island defining an inner suction inlet and an outer discharge chamber adjacent said inlet and outlet ports respectively, the inlet and outlet chambers in said rear cylinder head being in communication with said inlet suction line and said outlet discharge line, respectively; a compressor drive shaft having its ends rotatably mounted in front and rear axially spaced bores of said cylinder blocks by means of front and rear bearings, said cylinder blocks having first passage means for conveying comprsssed gas between said head outlet chambers, each of said cylinder blocks each having a suction cavity in their outer end faces to provide front and rear suction cavities, said cylinder blocks having second suction crossover passage means therein for connecting said front and rear suction cavities, said cylinder having six aligned pumping chambers spaced radially outward from the central axis of said shaft, three double ended pistons arranged to reciprocate within said pumping chambers, a swash plate disposed between said cylinder blocks and secured to said shaft so as to rotate therewith, means whereby rotation of said swash plate imparts reciprocation to said double ended pistons, said front and rear valve plate having three reed valves thereon for controlling the discharge of gas through said outlet ports wherein the improvement comprises said front head having a plurality of radial reinforcement ribs extending between said intermediate closed rib and said peripheral rib defining three discharge gas pockets muffling sound energy in gases flowing therethrough during operation of the compressor, said radial ribs having notches therein to allow the gases to flow between said pockets to the discharge line.

3. In a compressor, a cylindrical casing element, a pair of cylinder blocks disposed intermediate the ends of said cylindrical casing element defining a crankcase therebetween, front and rear cylinder heads disposed within opposite ends of said cylindrical casing element, said rear cylinder head having an inlet suction line and an outlet discharge line, valve plate means interposed between said cylinder heads and cylinder blocks and having inlet and outlet ports therein, said cylinder heads each having a circular peripheral rib and an intermediate closed rib island defining an inner suction inlet chamber and an outer discharge outlet chamber adjacent said inlet and outlet ports respectively, the inlet and outlet chambers in said rear cylinder head being in communication with said inlet suction line and said outlet discharge line, respectively; a compressor drive shaft having its ends rotatably mounted in front and rear axially spaced shaft bores of said cylinder blocks by means of front and rear journal bearing means, said cylinder blocks having first passage means for conveying compressed gas between said head outlet chambers, each of said cylinder blocks each having a suction cavity in their outer end faces to provide front and rear suction cavities, said cylinder blocks having second suction crossover passage means therein for connecting said front and rear suction cavities, said cylinder blocks having a plurality of paired aligned pumping chambers spaced radially outward from the central axis of said shaft, a double ended piston arranged to reciprocate within each pair of the aligned pumping chambers, a swash plate disposed between said cylinder blocks and secured to said shaft so as to rotate therewith, means whereby rotation of said swash plate imparts reciprocation to said double ended pistons, front and rear drive shaft thrust bearing means between said swash plate and the inner ends of said front and rear shaft bores so as to be in communication with the crankcase chamber, wherein the improvement comprising having the rear end surface of said shaft spaced a defined distance from the inner surface of said rear valve plate means, the front end of said shaft extending through aligned openings in said front valve plate means and through said front head suction chamber whereby said front shaft bore is in communication therewith, said aligned openings of a sufficient diameter to permit oil to flow from said front shaft bore into said front head suction chamber, said rear cylinder block having a radial slot formed in its outer face providing communication between said rear suction cavity and the outer end of said rear shaft bore whereby a differential suction pressure gradient is created therebetween which cooperates with the oil-refrigerant gas piston chamber blow-by during each compressive stroke of the pistons to provide a first flow of lubricating oil through the compressor rear thrust and journal bearing means, said first oil flow being from said crankcase through said rear thrust bearing means and rear journal bearing means via said rear shaft bore for generally upward flow in said rear radial slot into said rear suction cavity, and thence via said suction crossover passge into said front suction cavity for differential pressure flow into said front head suction chamber and thence via piston blow-by into said front piston chambers for differential pressure return to said crankcase, and said second oil flow being from said crankcase through said front thrust and front journal bearing means via said front shaft bore, through said aligned shaft openings into said front head suction chamber for return to said crankcase with said first oil flow.

* * * * *